US006935491B2

(12) United States Patent
Marco

(10) Patent No.: US 6,935,491 B2
(45) **Date of Patent: *Aug. 30, 2005**

(54) FILM MULTIPACKAGE

(75) Inventor: Leslie S. Marco, Bloomingdale, IL (US)

(73) Assignee: Illinois Tool Works Inc., Glenview, IL (US)

( * ) Notice: Subject to any disclaimer, the term of this patent is extended or adjusted under 35 U.S.C. 154(b) by 108 days.

This patent is subject to a terminal disclaimer.

(21) Appl. No.: 10/417,684

(22) Filed: Apr. 17, 2003

(65) Prior Publication Data

US 2003/0192788 A1 Oct. 16, 2003

Related U.S. Application Data

(63) Continuation-in-part of application No. 09/777,628, filed on Feb. 6, 2001, now Pat. No. 6,564,530, which is a continuation-in-part of application No. 09/220,428, filed on Dec. 24, 1998, now Pat. No. 6,213,293.

(51) Int. Cl.[7] ..... B65D 75/00

(52) U.S. Cl. ..... 206/150; 206/151

(58) Field of Search ..... 206/139, 140, 206/147, 148, 150, 151, 162, 427, 432, 434, 497

(56) References Cited

U.S. PATENT DOCUMENTS

| | | | |
|---|---|---|---|
| 2,359,297 | A | 10/1944 | Brogden |
| 2,654,474 | A | 10/1953 | Ringler |
| 2,701,661 | A | 2/1955 | Murray |
| 2,946,621 | A | 7/1960 | Williamson |
| 3,084,792 | A | 4/1963 | Poupitch |
| 3,118,537 | A | 1/1964 | Copping |
| 3,186,544 | A | 6/1965 | Curry |
| 3,198,327 | A | 8/1965 | Boehling et al. |
| 3,200,944 | A | 8/1965 | Rapata |
| 3,214,016 | A | 10/1965 | Stephan |
| 3,217,874 | A | 11/1965 | Potter |
| 3,325,004 | A | 6/1967 | Wanderer |
| 3,410,596 | A | 11/1968 | Slevin, Jr. |
| 3,460,863 | A | 8/1969 | Schaich |
| 3,509,684 | A | 5/1970 | Hohl |
| 3,570,746 | A | 3/1971 | Wood |
| 3,700,275 | A | 10/1972 | Deasy |
| 3,899,076 | A | 8/1975 | Florian |
| 4,121,401 | A | 10/1978 | Duerr et al. |
| 4,378,879 | A | 4/1983 | Killy |
| 4,403,689 | A | 9/1983 | Wood |
| 4,471,870 | A | 9/1984 | Uhlig |
| 4,523,676 | A | 6/1985 | Barrash |
| 4,560,064 | A | 12/1985 | Peterson et al. |
| 4,637,515 | A | 1/1987 | Wilson et al. |
| 4,779,731 | A | 10/1988 | Fujio |
| 4,807,751 | A | 2/1989 | Klygis et al. |
| 4,828,110 | A | 5/1989 | Lems |
| 4,893,712 | A | 1/1990 | Allen et al. |

(Continued)

FOREIGN PATENT DOCUMENTS

| | | |
|---|---|---|
| EP | 1 013 564 | 6/2000 |
| FR | 2 015 754 | 4/1970 |
| FR | 2 169 442 | 9/1973 |
| WO | 93/14992 | 8/1993 |

*Primary Examiner*—Jim Foster
(74) *Attorney, Agent, or Firm*—Pauley Petersen & Erickson

(57) ABSTRACT

This invention relates to a single-piece carrier for unitizing a plurality of containers with a retainer sheet integrated with a carrier sleeve. The retainer sheet comprises a plurality of container receiving openings for engaging a top portion of each container while the carrier sleeve surrounds the plurality of containers. Packages preferably comprise two or more layers of containers within the carrier sleeve separated by a divider.

20 Claims, 11 Drawing Sheets

U.S. PATENT DOCUMENTS 4,919,265 A * 4/1990 Lems et al. ..... 206/432
4,932,528 A 6/1990 Benno
5,305,877 A 4/1994 Olsen
5,311,984 A 5/1994 Harris
5,328,024 A 7/1994 Sutherland
5,360,104 A 11/1994 Sutherland
5,390,784 A 2/1995 Sutherland
5,425,446 A 6/1995 Weaver et al.
5,437,370 A 8/1995 Marco
5,487,463 A 1/1996 Harris
5,538,133 A 7/1996 Campbell et al.
5,582,289 A 12/1996 Wright
5,590,776 A 1/1997 Galbierz et al.
5,653,334 A 8/1997 Marco
5,701,994 A 12/1997 Marsh
5,765,684 A 6/1998 Van Dore et al.
6,145,656 A 11/2000 Marco

* cited by examiner

FILM MULTIPACKAGE

CROSS REFERENCE TO RELATED APPLICATION

This application is a continuation-in-part of U.S. patent application Ser. No. 09/777,628, filed 06 Feb. 2001 now U.S. Pat. No. 6,564,530, which is a continuation-in-part application Ser. No. 09/220,428 filed Dec. 24, 1998 now U.S. Pat. No. 6,213,293, which issued on 10 Apr. 2001.

BACKGROUND OF THE INVENTION

1. Field of the Invention

This invention relates to a device and method of manufacture of the device for unitizing a plurality of containers, the carrier having a retainer sheet for engaging a top portion of the containers integrated with a film sleeve for surrounding the containers.

2. Description of Prior Art

Conventional container carriers are often used to unitize a plurality of similarly sized containers, such as cans, bottles, jars and boxes, although other packages or containers may be unitized. Plastic ring carriers and box carriers are two such conventional container carriers.

The plastic ring carrier produces a unitized package for containers using little material. However, the plastic ring carrier, when used alone in most instances, has little or no advertising or promotional printing space. Conversely, the box carrier generally has a relatively large amount of area for promotional graphics. Disadvantageously, the box carrier requires a relatively large amount of material, may permit containers to fall out if it is not maintained in an upright position, and usually shrouds most or all of the actual containers. Therefore, there is a need for a package that incorporates the stability and economy of a ring carrier and the promotional area of a box carrier.

SUMMARY OF THE INVENTION

It is one object of this invention to provide a container carrier that unitizes a plurality of containers into a tight, solid package.

It is another object of this invention to provide a container carrier that provides a prominent billboard space for merchandising information.

It is still another object of this invention to provide a container carrier which restricts lateral and vertical movement of the containers with respect to one another.

It is yet another object of this invention to provide a container carrier that incorporates the stability and economy of a ring carrier and the promotional area of a box carrier.

It is still another object of this invention to provide a container carrier that utilizes a film sleeve to maintain a tight configuration of unitized containers.

A carrier according to this invention carries a plurality of containers such as cans or bottles. The carrier unitizes a plurality of containers to create a package. The carrier is a single-piece device comprising a retainer sheet integrated with a film sleeve, each preferably constructed from a flexible, resilient material such as plastic. The retainer sheet preferably has a first thickness different from and thicker than a second thickness of the film sleeve.

The retainer sheet is formed with a plurality of container receiving openings the number of which depends upon the intended size of the package. The retainer sheet is integrated with the film sleeve preferably along longitudinal sides of the retainer sheet.

The film sleeve may be designed to create a package open at a bottom of the package or along a lower edge of the carrier. The film sleeve may further include a bottom along a portion of the lower edge of the film sleeve. Each side edge of the film sleeve is preferably bound with a seal. The carrier when formed is preferably generally symmetrical around fold lines of the carrier.

Containers are inserted within the carrier so that the containers are surrounded by between five and six sides of the package. Each container receiving opening in the retainer sheet preferably engages a container around an upper portion of the container. The rigidity and elasticity of the retainer sheet thereby supports each container.

The film sleeve is positioned around the plurality of containers, preferably in a stretching engagement with the containers. The film sleeve is preferably printed with graphics, promotional and/or other information related to contents and/or ingredients of package. Therefore, the film sleeve serves both to unitize the plurality of containers and to advertise the nature of the contents of the containers.

The carrier is preferably manufactured according to one of several preferred methods wherein a generally continuous length of carriers is formed. In summary, a film substrate and/or film sleeve material is printed with desired graphics and other merchandising information. A retainer sheet material is next joined to the film substrate and/or film sleeve material by heat sealing, extrusion coating, laminating, profile extrusion or glueing the retainer sheet material to the film substrate and/or film sleeve material. The joined retainer sheet material and film substrate and/or film sleeve material are next either folded along a fold line to create a symmetrical double layer or laminated to an identical section of joined retainer sheet material and film substrate and/or film sleeve material thereby creating a carrier blank. Seams are next added by heat sealing or laminating the symmetrical double layer of retainer sheet material and film substrate and/or film sleeve material together. Finally, the carrier is formed by die cutting the double layer of retainer sheet material and film substrate to create container receiving openings and to define a film sleeve and a retainer sheet.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
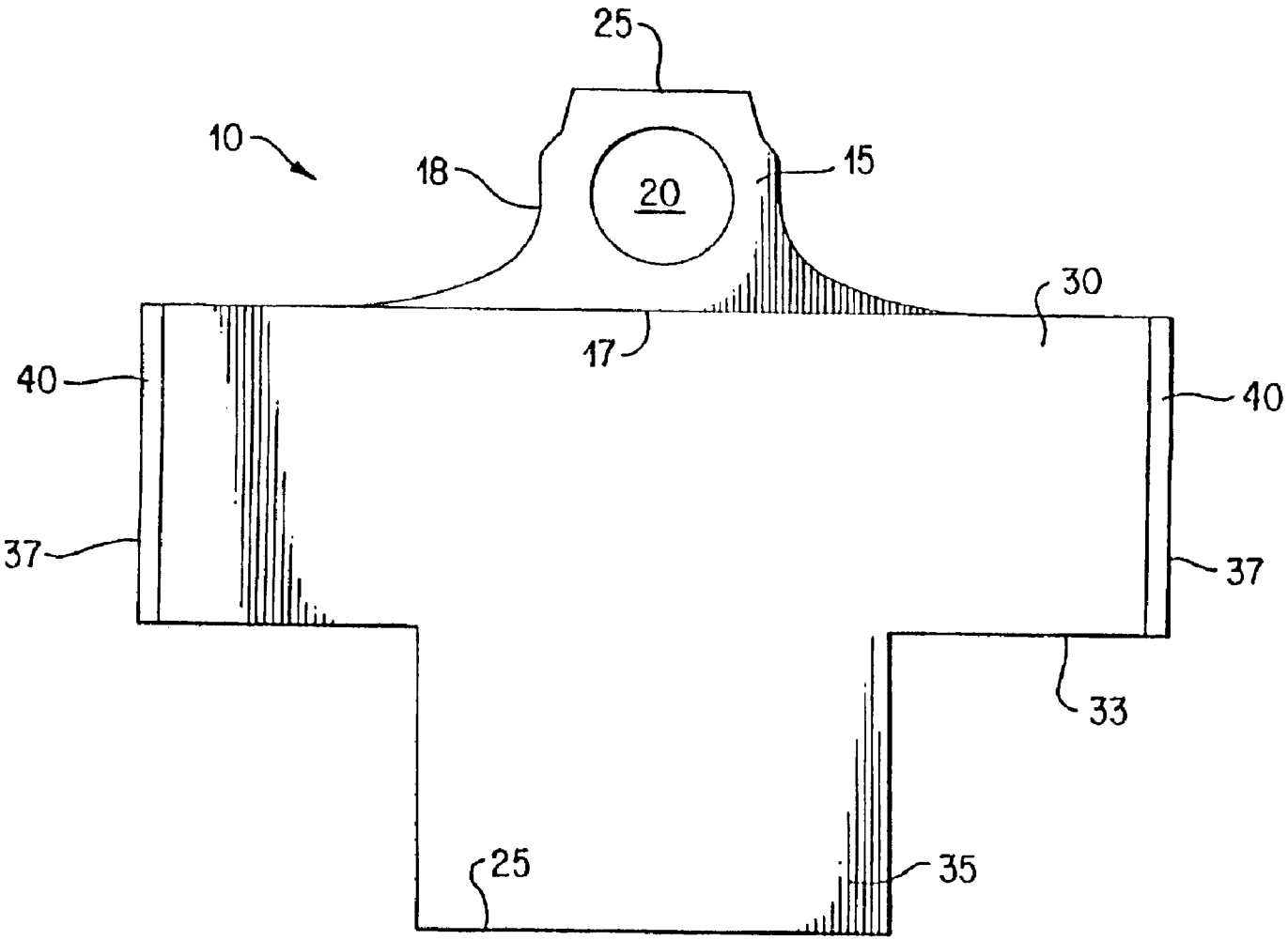
FIG. 1 is a top view of a carrier for holding a plurality of containers according to one preferred embodiment of this invention.
Figure 2:
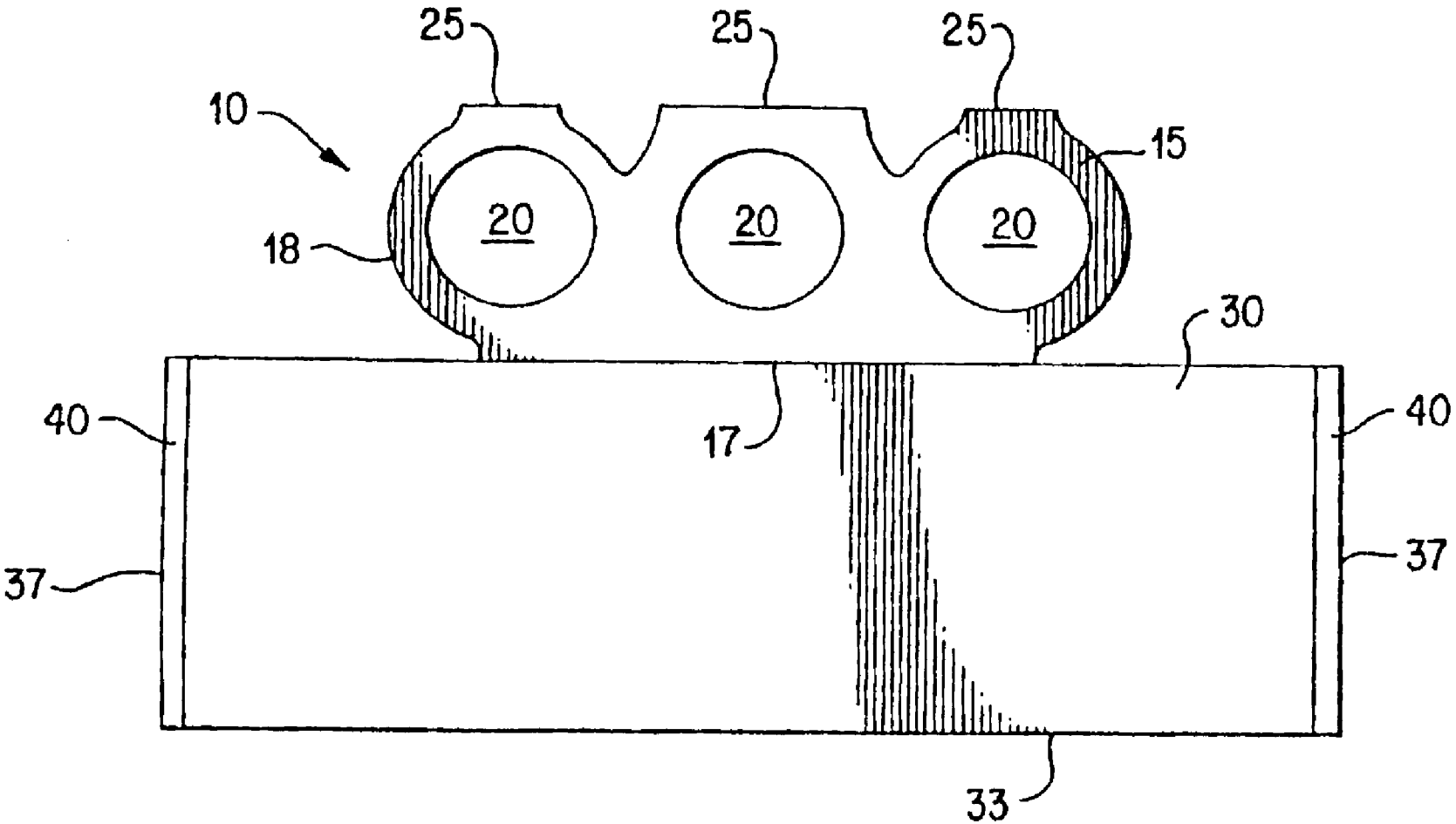
FIG. 2 is a top view of a carrier for holding a plurality of containers according to another preferred embodiment of this invention.
Figure 3:
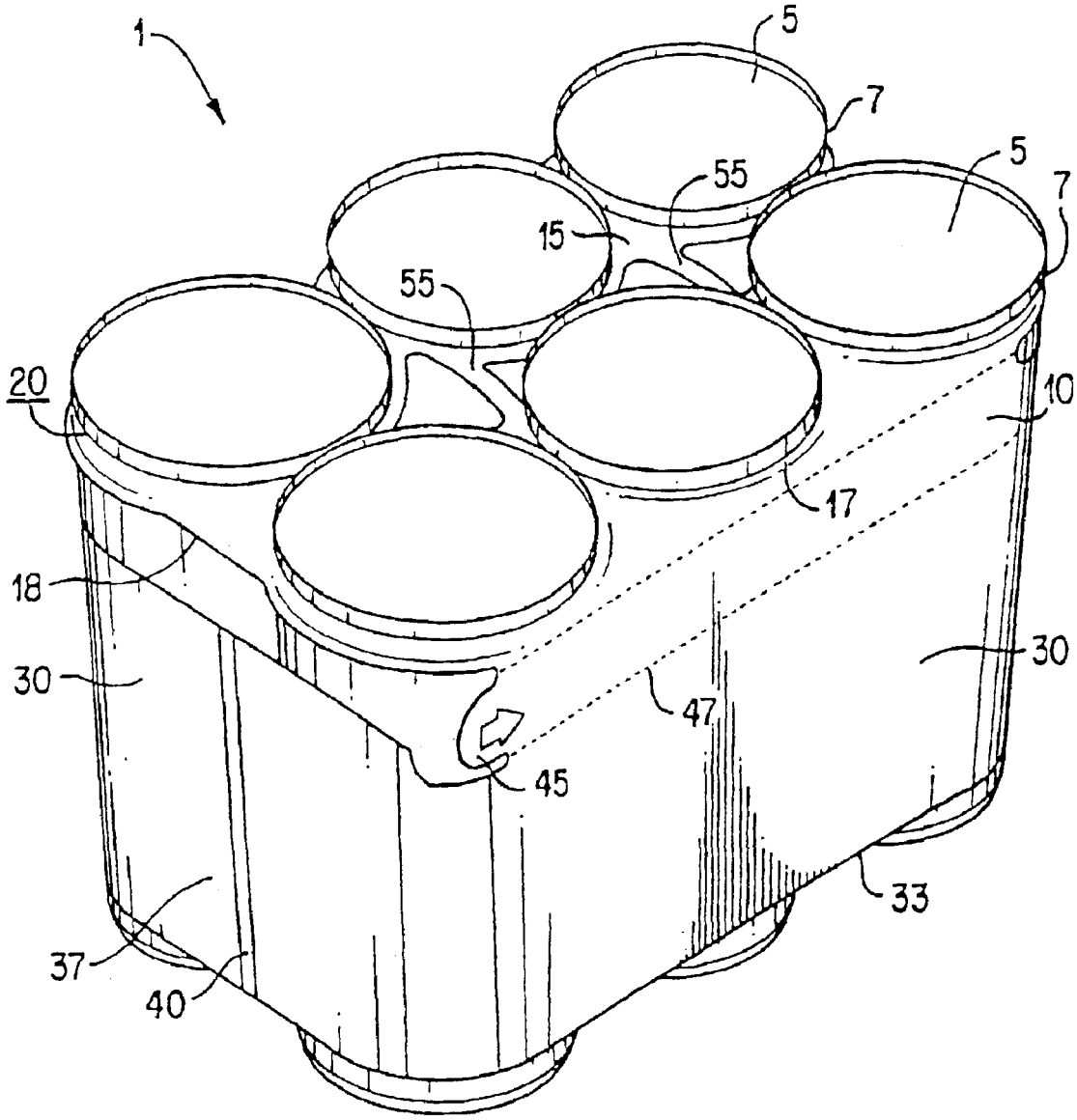
FIG. 3 is a perspective view of a package of containers, using a carrier similar to the carrier shown in FIG. 2, according to one preferred embodiment of this invention.
Figure 4:
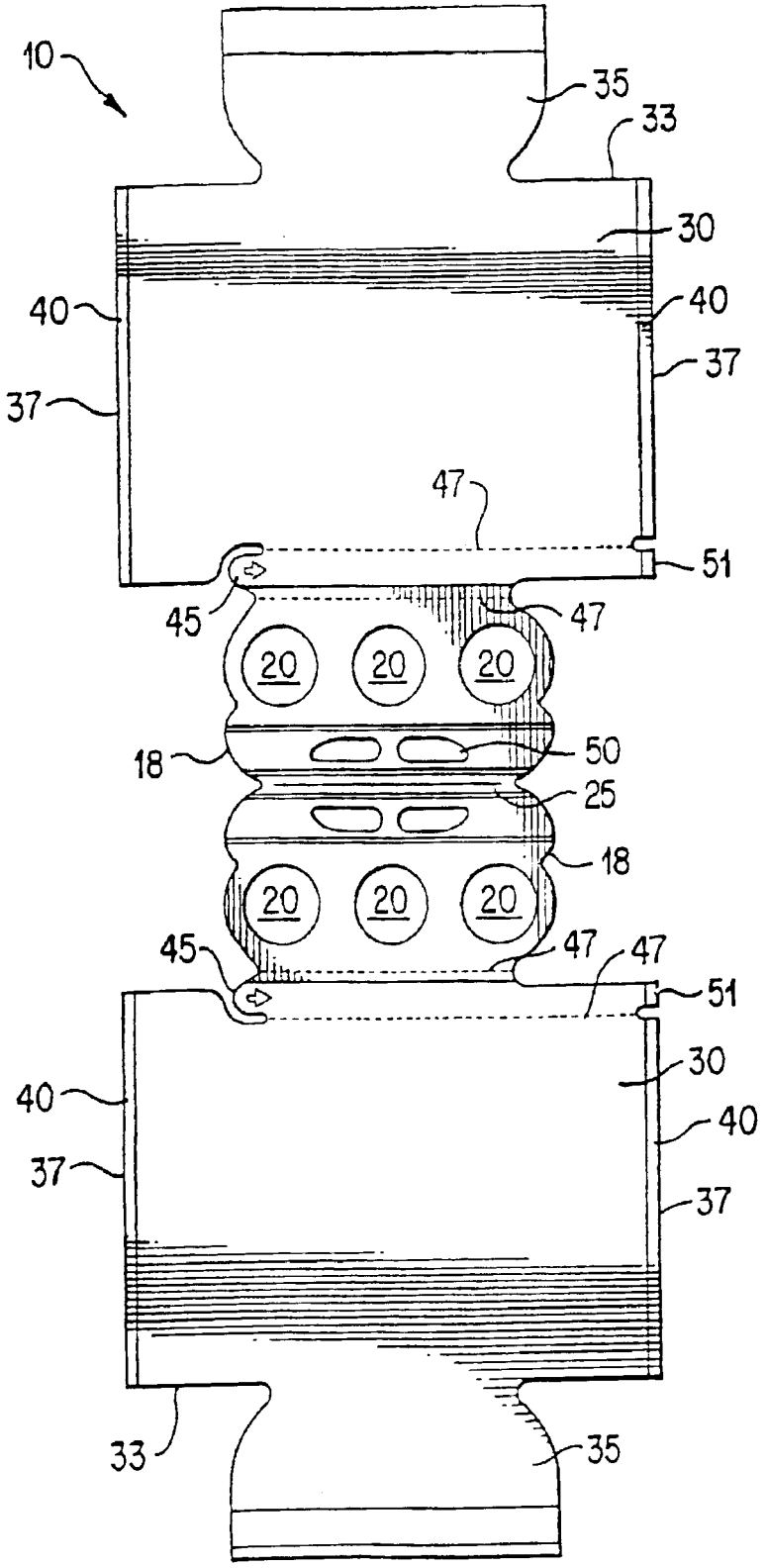
FIG. 4 is a top view of a carrier for holding a plurality of containers according to another preferred embodiment of this invention.

FIGS. 1–11 show carriers 10 for carrying a plurality of containers 5. Containers 5 as shown in FIGS. 3 and 4 are preferably cans. Although cans are shown in FIGS. 3 and 4, bottles or any other commonly unitized container 5 may be used with carrier 10 according to this invention. Containers 5 are preferably like-sized within a single carrier 10.

Figure 5:
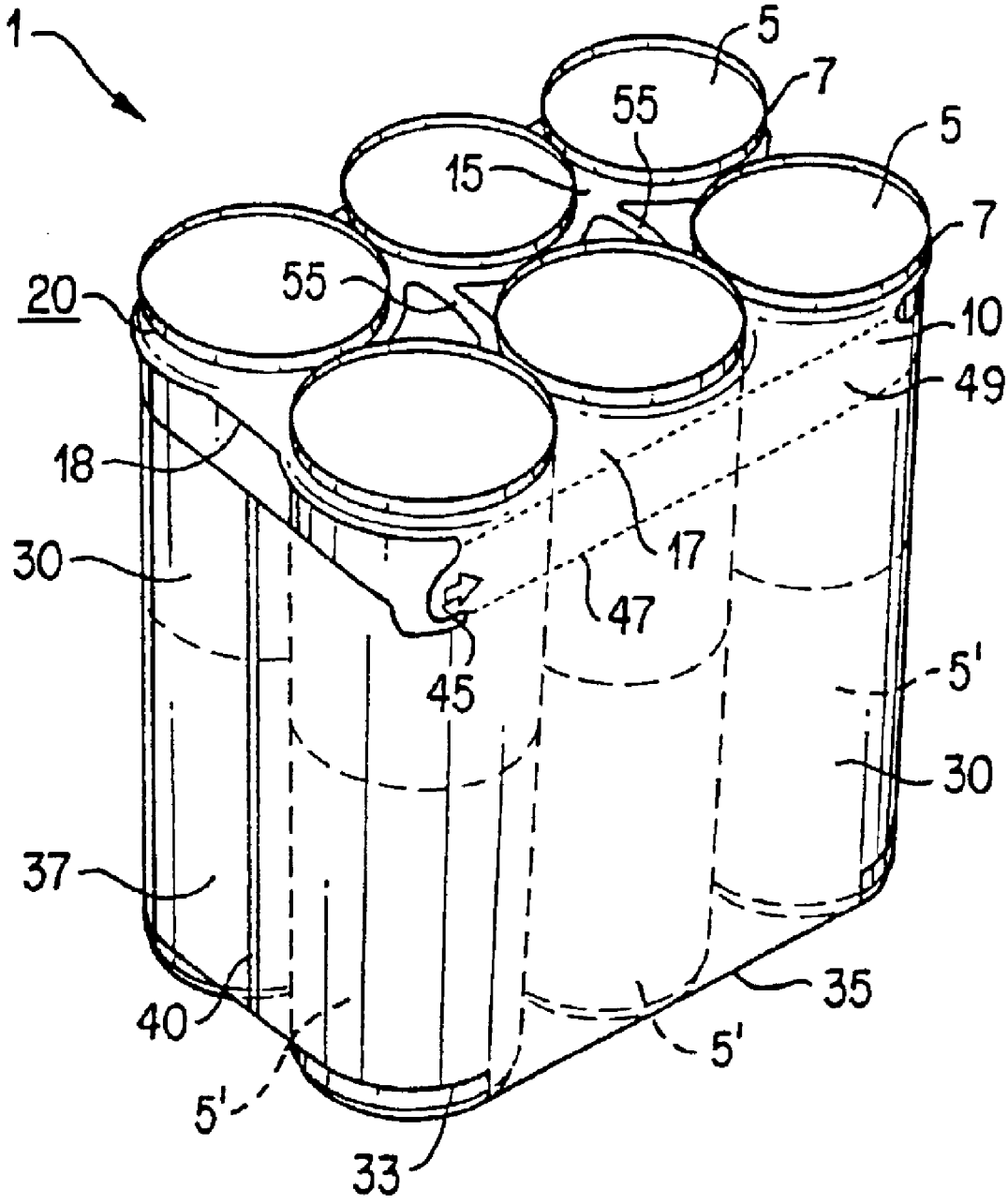
FIG. 5 is a perspective view of a package of containers, using a carrier similar to the carrier shown in FIG. 4, according to one preferred embodiment of this invention.

Carrier 10 unitizes a plurality of containers 5 to create package 1, such as package 1 shown in FIGS. 3 and 5. Carrier 10 is preferably a single-piece device comprising retainer sheet 15 integrated with film sleeve 30, each preferably constructed from a flexible, resilient material such as plastic. For the purposes of this specification and claims, a sleeve is defined as a tubelike component capable of fitting over or around a plurality of containers 5.

In one preferred embodiment of this invention, retainer sheet 15 is made from low density polyethylene. In other embodiments, a higher density polyethylene is preferable having a different thickness. Retainer sheet 15 preferably has a first thickness, such as between 0.008–0.020", possibly thinner than the thickness of traditional plastic ring carriers. As discussed in additional detail below, retainer sheet 15 is preferably cut, using means known to those skilled in the art such as a stamping die, to form a plurality of container receiving openings 20 in retainer sheet 15. Two or more container receiving openings 20 are formed in retainer sheet 15 in longitudinal rows and one or more transverse ranks. In one preferred embodiment of this invention shown in FIGS. 2–5, container receiving openings 20 are configured in two rows of three ranks. Retainer sheet 15 may include other configurations of container receiving openings 20 depending on the size of package 1 desired.

Retainer sheet 15 is integrated with film sleeve 30 to form a single-piece carrier 10, as described in detail below. According to one preferred embodiment of this invention, film sleeve 30 has a second thickness that is thinner than the first thickness of retainer sheet 15, such as 0.004" to 0.006". The total thickness of retainer sheet 15 may range between approximately 0.008–0.026" according to one preferred embodiment of this invention. Film sleeve 30 may exhibit different elasticity and different rigidity than retainer sheet 15. Film sleeve 30 may comprise a stretchable low density polyethylene (LDPE) film or similar material known to those having ordinary skill in the art.

In one preferred embodiment of this invention, shown in FIGS. 6, 8, 9 and 10, handle 50 is integrated within retainer sheet 15. Handle 50 preferably has a same or similar thickness as retainer sheet 15. In one preferred embodiment of this invention, shown in FIGS. 6 and 8, handle 50 is integrated between longitudinal rows of container receiving openings 20. Alternatively, package 1 may be carried using bands 55 formed between container receiving openings 20 as shown in FIGS. 3 and 5.

Film sleeve 30 is preferably integrated with retainer sheet 15 along longitudinal sides 17 of retainer sheet 15. In one preferred embodiment of this invention, film sleeve 30 is not connected along two lateral edges 18 of retainer sheet 15. Film sleeve 30 is preferably printed with, on one or both sides, UPC and proof of purchase labels, graphics, and promotional and/or other information related to contents and/or ingredients of package 1. Film sleeve 30 may additionally be at least partially transparent to effectively display the nature of containers 5. Therefore, film sleeve 30 serves the dual purposes of retaining containers 5 within a tightly assembled package 1 and advertising marketable features of the containers 5 and/or package 1.

In one preferred embodiment of this invention shown in FIG. 2, film sleeve 30 is open along lower edge 33 of carrier 10. As shown in FIG. 1, lower edge 33 of carrier 10 may further include bottom 35 of film sleeve 30. Each side edge 37 of film sleeve 30 is preferably bound with seal 40. Therefore, film sleeve 30 extends from openable lower edge 33 of carrier to seals 40 on either side edge 37 of film sleeve to retainer sheet 15 at a top portion of carrier 10.

As shown in FIGS. 1 and 2, carrier 10 is preferably generally symmetrical around fold lines 25. As discussed in detail below, carrier 10 is manufactured so that retainer sheet 15 and film sleeve 30 are each preferably symmetrical around fold lines 25.

Carrier 10 is applied to a plurality of containers 5 to form package 1, shown in FIGS. 3 and 5. Containers 5 are inserted within carrier 10 which bounds containers 5 around between five and six sides of package 1. Each container receiving opening 20 preferably engages container 5, preferably around chime 7 or similar upper portion of container 5. The rigidity and elasticity of retainer sheet 15 supports container 5 within container receiving opening 20. A top portion of package 1 is therefore at least partially covered by retainer sheet 15.

As shown in FIGS. 3 and 5, film sleeve 30 is positioned around the plurality of containers 5. Preferably, film sleeve 30 is stretchingly engaged with containers 5 and the combination of container receiving openings 20 and sleeve 30 prevents skewing or lateral movement of containers 5 with respect to each other. In one preferred embodiment of this invention, shown in FIGS. 2 and 3, film sleeve 30 covers at least a portion of four horizontal sides of package 1.

Containers 5 are positioned within package 1 so that film sleeve 30 is flat and tight with respect to containers 5 and prominent with respect to package 1. Film sleeve 30 is preferably sized to stretch when slid over a plurality of containers 5. Such a configuration of film sleeve 30 results in package 1 having a prominent display area or "billboard" for advertising, information, graphics and other marketing material.

In another preferred embodiment of this invention, shown in FIGS. 1, 4 and 5, film sleeve 30 covers at least a portion of a bottom of package 1. Film sleeve 30 preferably covers at least a portion of the bottom of package 1 when one or more containers 5 are not engaged with container receiving openings 20. For instance, carrier 10 shown in FIG. 1 requires bottom 35 because retainer sheet 15 includes only two container receiving openings 20 in carrier 10 that holds more than two containers 5. Carrier 10 shown in FIG. 5 also requires bottom 35 because, of the twelve containers 5 in package 10, the lower six containers 5' in package 1 are not supported around chime 7 by retainer sheet 15. Therefore, bottom 35 provides support for those containers 5 not supported within container receiving openings 20.

As shown in FIGS. 3–5, package 1 may additionally contain pull tab 45 and/or line of perforation 47 positioned within film sleeve 30. Using an arrangement such as shown in FIGS. 3–5, package 1 may be opened by pulling pull tab 45 across longitudinal side 17 of package 1 thereby tearing line of perforation 47 to access containers 5.

A package according to FIGS. 4 and 5 will have the novel characteristic of having an upper level of containers 5 removable from a lower level of container 5' while keeping the upper level of containers 5 integrated as a sub-package and permitting the lower level of containers 5' to be freely removable for individual consumption or storage.

Figure 6:
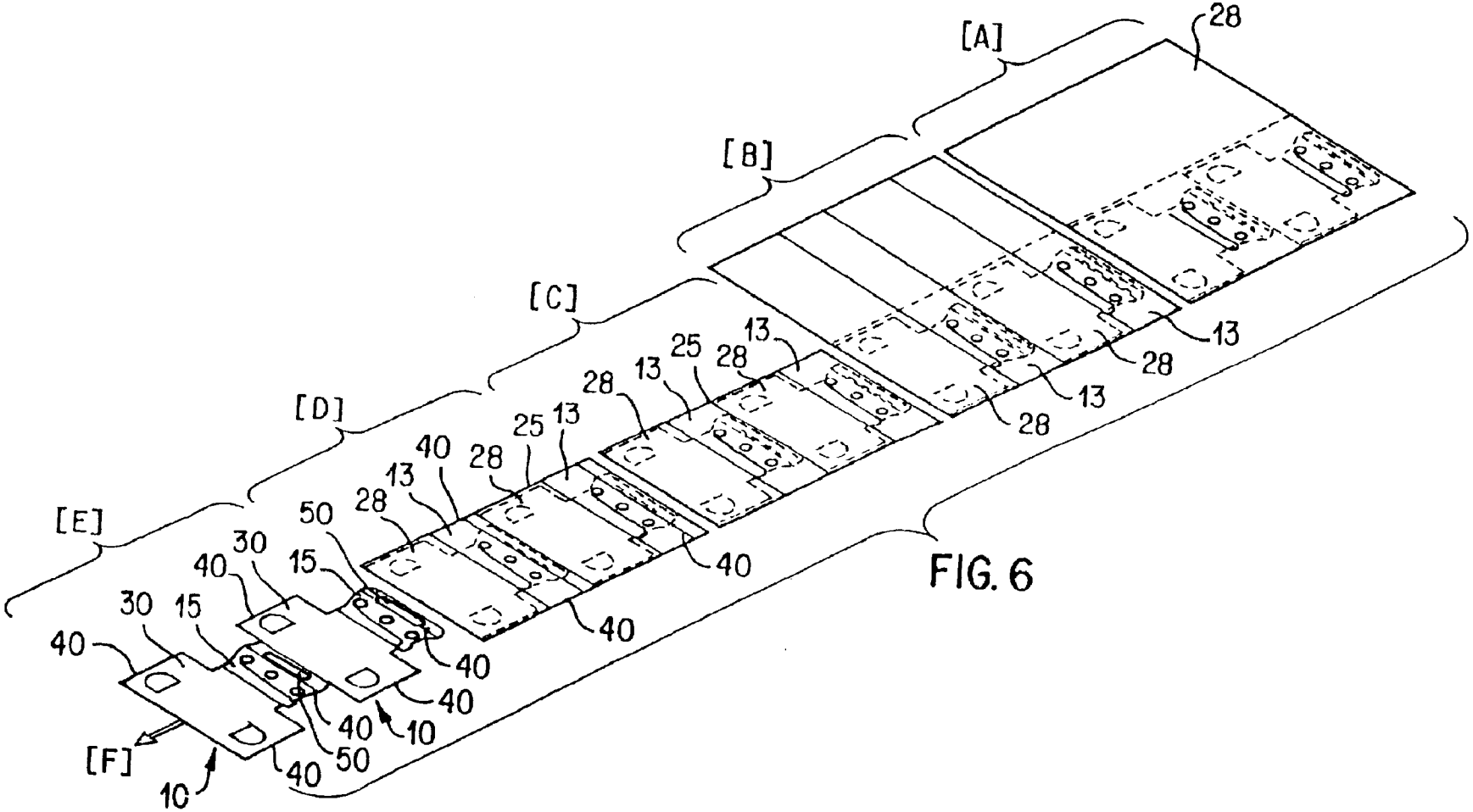
FIG. 6 is a schematic of a method for making a carrier for holding a plurality of containers according to one preferred embodiment of this invention.

According to one preferred embodiment of this invention, perforated removal strip 49 facilitates the efficient removal of the upper level of containers 5 and retainer sheet 15 from the lower level of containers 5 and sleeve 30. Perforated removal strip 49 is designed so a single pulling action of tab 45 circumferentially around package 1 will disassociate retainer sheet 15 and upper level of containers 5' from sleeve 30. Tabs 45 at an end panel of package 1 permit such single pulling action removal from either side of package 1. FIG. 6 shows carrier 10 according to this preferred embodiment, which is contemplated to be manufactured similar to FIG. 7, described below.

FIGS. 6–10 show methods for manufacturing carrier 10 according to three preferred methods of this invention. The methods shown in FIGS. 6–10 demonstrate from right to left the assembly of various components of carrier 10, each step in the method designated by a letter of the alphabet. Each step of each method of manufacture includes two carriers 10 to demonstrate a representative segment of carriers 10 that are typically formed in a generally continuous length.

FIG. 6 shows a method for manufacturing carrier 10 according to one preferred embodiment of this invention. In step [A] film substrate 28 is printed with desired graphics and other merchandising information. In step [B] retainer sheet material 13 is joined to film substrate 28 by glueing or otherwise attaching retainer sheet material 13 to film substrate 28. In step [C] retainer sheet material 13 and film substrate 28 are folded along fold line 25 to create a symmetrical double layer. In step [D] seams 40 are added by heat sealing or laminating the symmetrical double layer of retainer sheet material 13 and film substrate 28 together. In step [E] carrier 10 is formed by cutting, such as in a punch press, the double layer of retainer sheet material 13 and film substrate 28 to define film sleeve 30 and retainer sheet 15. Step [F] (not shown) preferably comprises accumulating the continuous strip of carriers 10 by fan folding or rolling about a core. Carriers 10 according to this invention, regardless of the method of manufacture, are not conducive to winding on reels because of the variable thickness between film sleeve 30 and retainer sheet 15.

Figure 7:
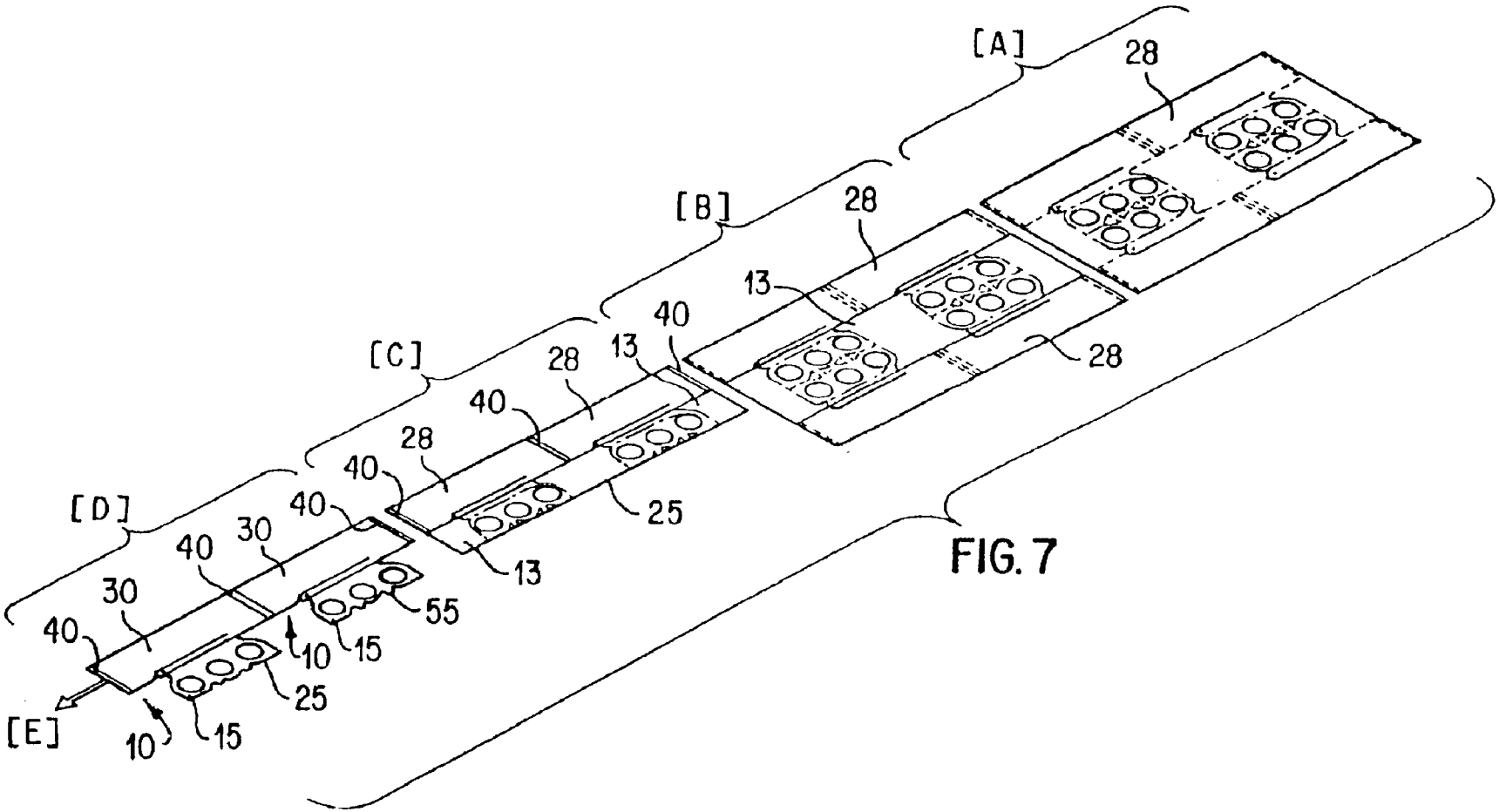
FIG. 7 is a schematic of a method for making a carrier, similar to the carriers shown in FIGS. 2 and 3, for holding a plurality of containers according to another preferred embodiment of this invention.

FIG. 7 shows a method for manufacturing carrier 10 according to another preferred embodiment of this invention. In step [A] film substrate 28 is printed with desired graphics and other merchandising information. In step [B] retainer sheet material 13 is joined to film substrate 28 by extrusion coating, laminating, profile extrusion, or glueing retainer sheet material 13 to film substrate 28. In step [C] retainer sheet material 13 and film substrate 28 are folded along fold line 25 to create a symmetrical double layer and seams 40 are added by heat sealing or laminating the symmetrical double layer of retainer sheet material 13 and film substrate 28 together. In step [D] carrier 10 is formed by cutting, such as in a punch press, the double layer of retainer sheet material 13 and film substrate 28 to define film sleeve 30 and retainer sheet 15. Step [E] (not shown) preferably comprises accumulating the continuous strip of carriers 10 by fan folding or rolling about a core.

Figure 8:
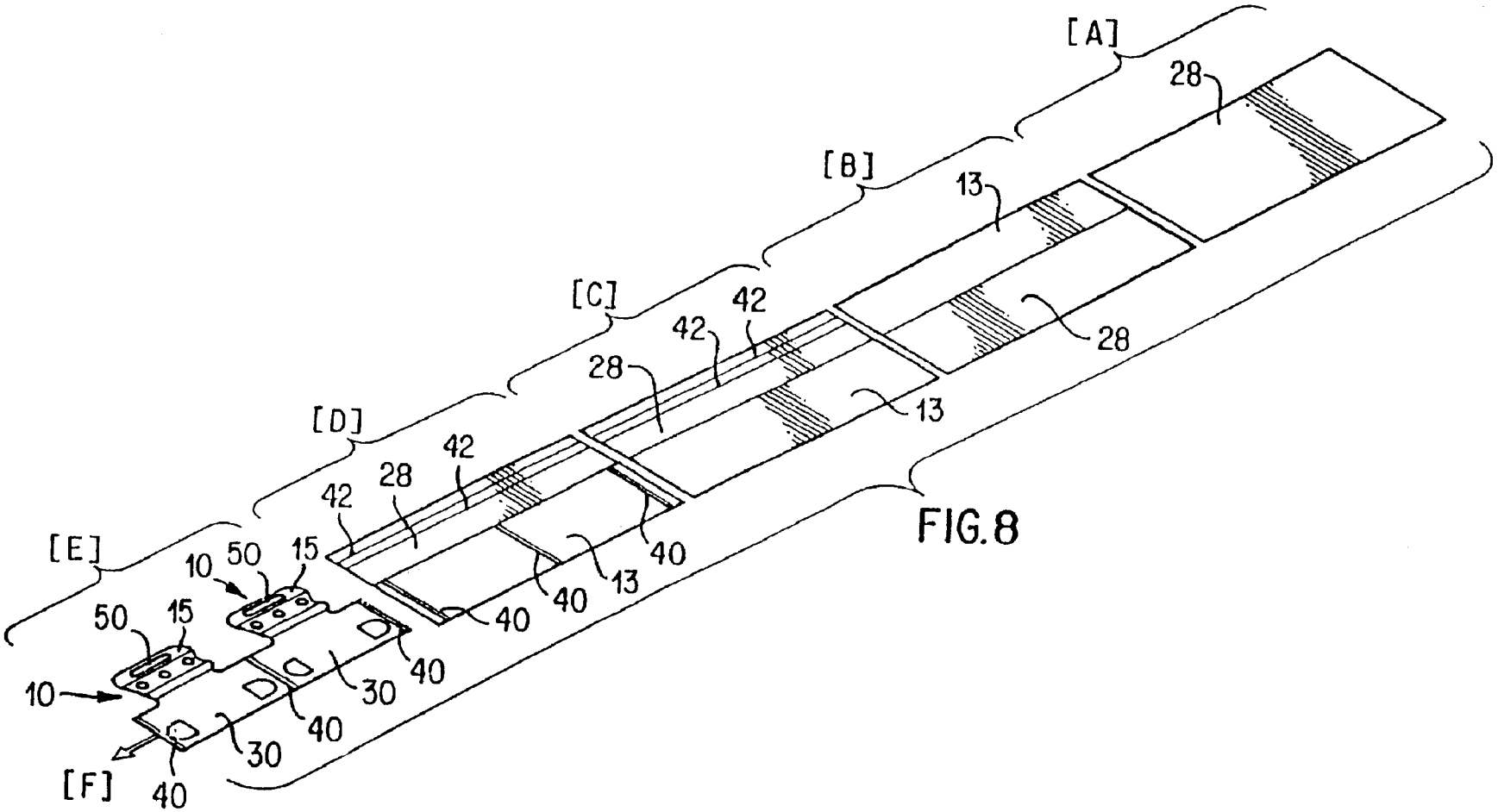
FIG. 8 is a schematic of a method for making a carrier for holding a plurality of containers according to yet another preferred embodiment of this invention.

FIG. 8 shows a method for manufacturing carrier 10 according to yet another preferred embodiment of this invention. In step [A] film substrate 28 is printed with desired graphics and other merchandising information. In step [B] retainer sheet material 13 is joined to film substrate 28 by extrusion coating or laminating retainer sheet material 13 to film substrate 28. In step [C] two identical sheets of retainer sheet material 13 and film substrate 28 are laminated together along lamination lines 42. Step [C] requires careful registration to align two identical portions of joined retainer sheet material 13 and film substrate 28 prior to lamination. In step [D] seams 40 are added by heat sealing or laminating the two identical sheets of retainer sheet material 13 and film substrate 28 together. In step [E] carrier 10 is formed by cutting, such as in a punch press, the two sheets of retainer sheet material 13 and film substrate 28 to define film sleeve 30 and retainer sheet 15. Step [F] (not shown) preferably comprises accumulating the continuous strip of carriers 10 by fan folding or rolling about a core.

Figure 9:
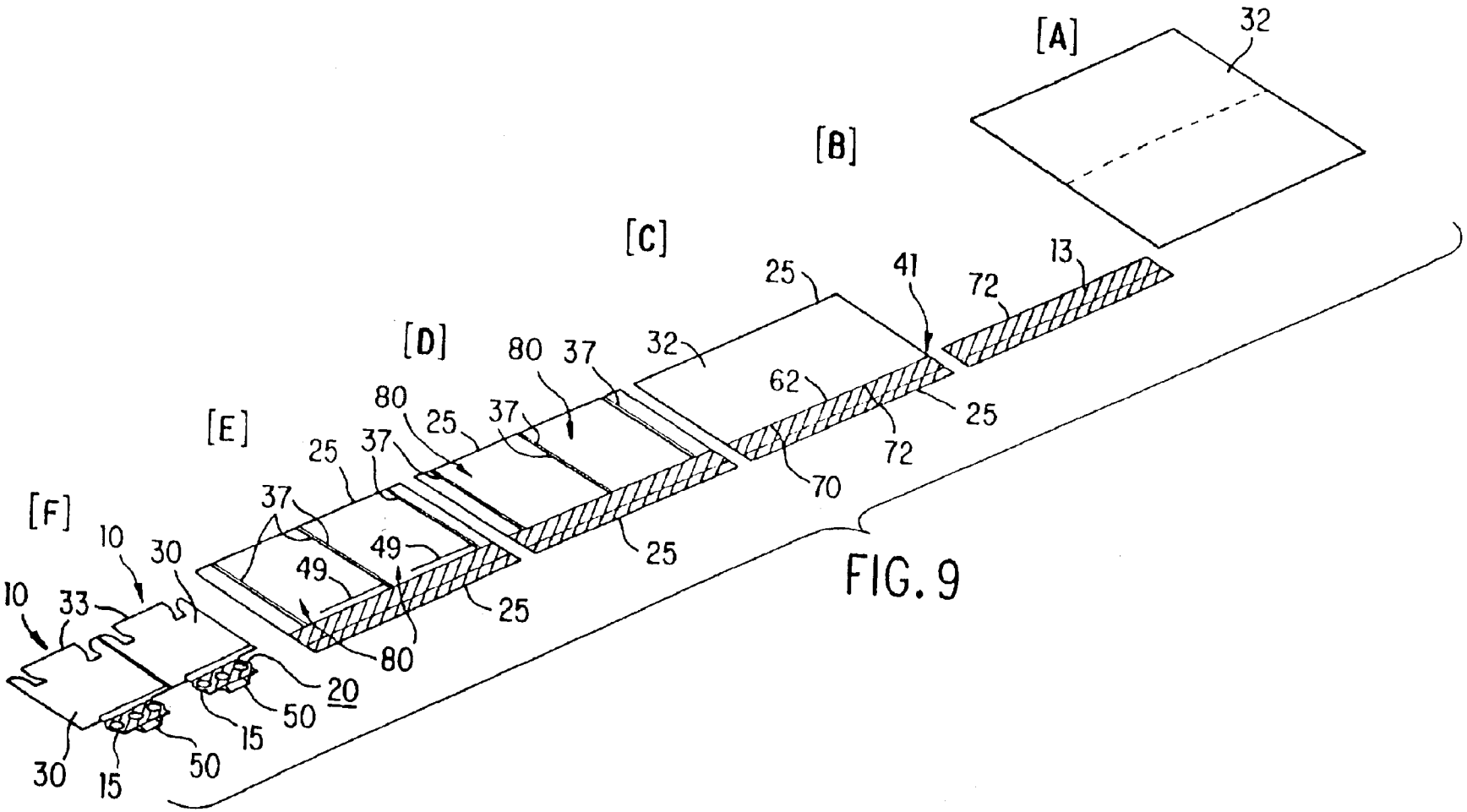
FIG. 9 is a schematic of a method for making a carrier for holding a plurality of containers according to yet another preferred embodiment of this invention.

Another method for manufacturing carrier 10 for carrying a plurality of containers is shown in FIG. 9. As shown in step [A], film sleeve material 32 is preprinted with appropriate graphics and/or product information. Step [B] shows retainer sheet material 13 provided for incorporation with film sleeve material 32. Retainer sheet material 13 is either folded and/or comprises a pair of sheets laid on top of each other and then may be laminated and/or sealed prior to incorporation with film sleeve material 32. Step [C] shows retainer sheet material 13 folded over and connected with respect to film sleeve material 32, such as with a heat seal 41, preferably near a periphery of two opposed edges 60 of retainer sheet material 32. As a result of the above-described steps, retainer sheet material 13 and film sleeve material 32 maybe manufactured, printed and shipped separately, i.e. on separate rolls or coils, prior to completion of final carrier 10.

As further shown in steps [C] and [D] of FIG. 9, retainer sheet material 13 is further attached with respect to film sleeve material 32 along a pair of opposed edges 60 along an open end 62 of the folded retainer sheet material 13 and a pair of opposed edges 70 along an open end 72 of the folded film sleeve material 32 to form carrier blank 80. According to a preferred embodiment of this invention, carrier 10 is preferably symmetrically formed about at least one fold line 25. Pair of opposed edges 60 of retainer sheet material 13 may be sealed, joined, bonded, adhered or any other attachment method known to those having ordinary skill in the art, to pair of opposed edges 70 of film sleeve material. Step [D] additionally shows the attachment of side edges 37 with respect to each other with welds and/or heat seals.

In steps [E] and [F], additional features of carrier 10 are formed including perforations defining removal strip 49 and the plurality of container receiving openings 20 to complete carrier 10. Step [F] also may require cutting lower fold line 25 so as to create open end 33 in carrier 10. As a result, carrier 10 includes an open end 33 sufficiently large to allow film sleeve 30 to be slid over at least a pair of containers 5.

Figure 10:
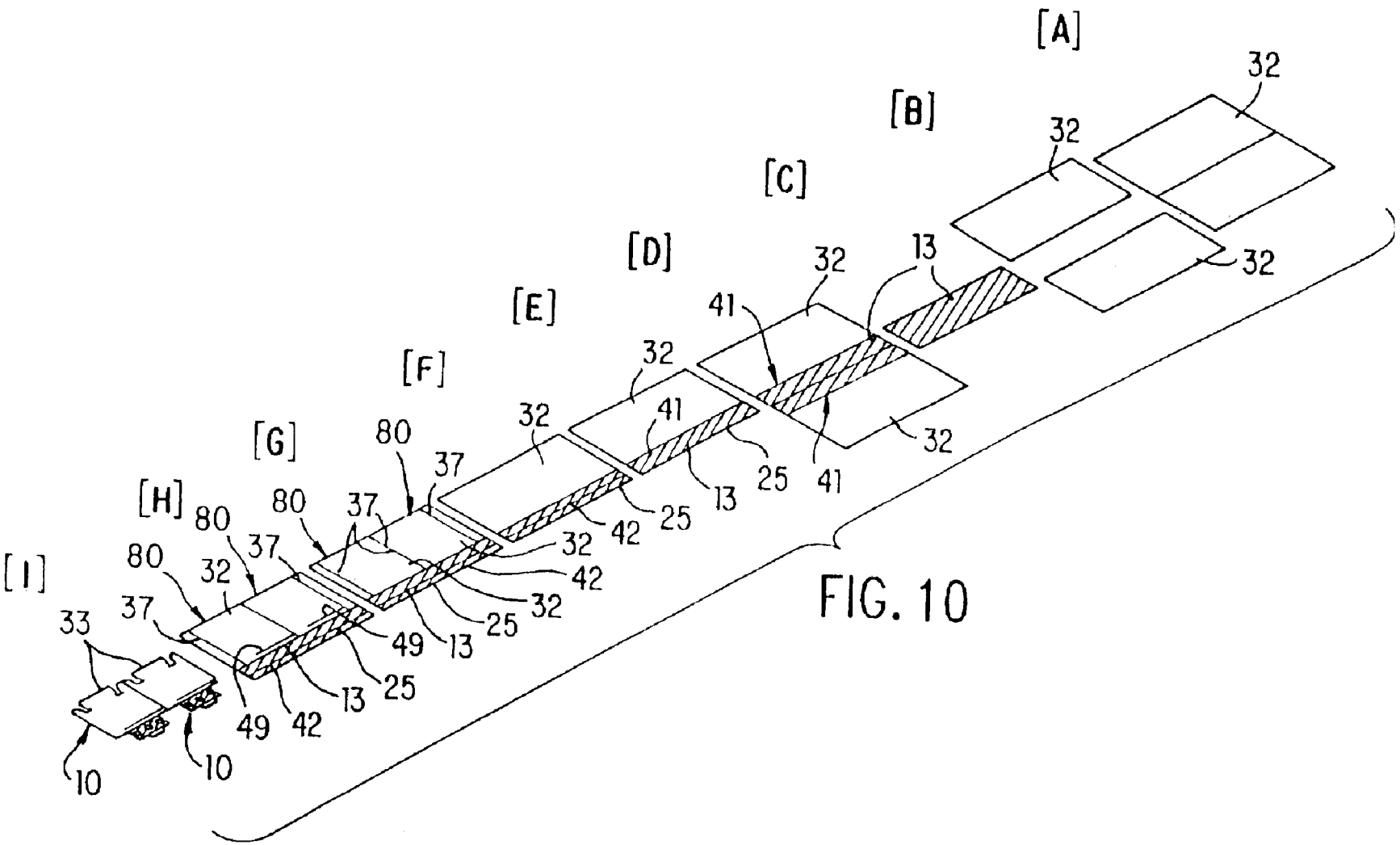
FIG. 10 is a schematic of a method for making a carrier for holding a plurality of containers according to yet another preferred embodiment of this invention.

Another method for manufacturing carrier 10 for carrying a plurality of containers is shown in FIG. 10. As shown in step [A] film sleeve material 32 is preprinted with appropriate graphics and/or product information. Step [B] shows film sleeve material 32 cut into two discrete sections. Alternatively, this method may start with step [B] wherein two separate sheets and/or coils of film sleeve material 32 are provided for incorporation into carrier 10. Step [C] shows retainer sheet material 13 provided for incorporation with film sleeve material 32. Retainer sheet material 13 is either folded and/or comprises a pair of sheets laid on top of each other and then may be laminated and/or sealed prior to incorporation with film sleeve material 32. Step [D] shows retainer sheet material 13 connected with respect to the two discrete sections of film sleeve material 32 along two sides of retainer sheet material 13, such as with seals 41, thereby forming one or more carrier blanks 80. Like the method shown in FIG. 9, this method permits retainer sheet material 13 and film sleeve material 32 to be manufactured, printed and shipped separately, i.e. on separate rolls, prior to completion of final carrier 10.

As further shown in step [E] of FIG. 10, according to a preferred embodiment of this invention, carrier blank 80 is preferably symmetrically formed about at least one fold line 25 or comprises two or more sheets welded and/or laminated with respect to each other. Step [F] additionally shows the placement of laminations or longitudinal seals 42 to create a spine for retainer sheet 15. Steps [G], [H] and [I] further show the attachment of sealed side edges 37 with respect to each other with welds and/or heat seals as well as additional features of carrier 10 including perforations defining removal strip 49 and the plurality of container receiving openings 20 to complete carrier 10. As shown in step [H], tear or removal strip 49 is positioned below seal 41. According to one preferred embodiment of this invention, handle 50 is also formed in carrier 10.

As described in the various embodiments of this invention, retainer sheet material 13 and/or retainer sheet 15 may have a first thickness and film sleeve material 32 and/or film sleeve 30 may have a second thickness thinner than the first thickness. Alternatively, the first thickness and the second thickness maybe the same. Finally, regardless of the relative thicknesses, retainer sheet material 13 and film sleeve material 32 may have different rigidities and/or elasticities.

Also as described in the various embodiments of this invention, retainer sheet material 13, retainer sheet 15, film sleeve material 32 and/or film sleeve 30 may be shipped on a single coil of material, on separate coils between retainer sheet material 13 and film sleeve material 32 or each on multiple coils for incorporation into carrier 10.

Figure 11:
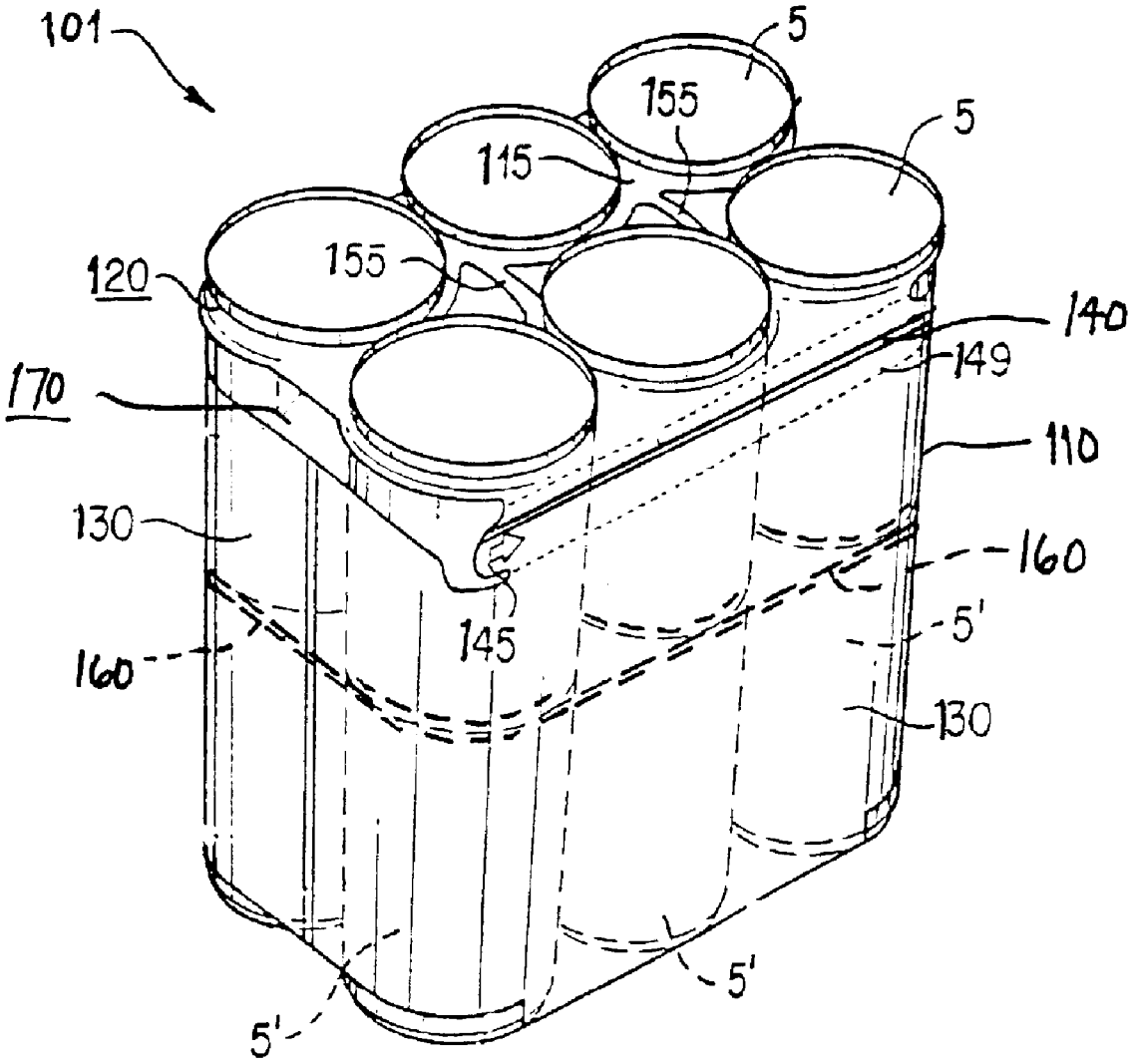
FIG. 11 is a perspective view of a package of containers according to one preferred embodiment of this invention.

According to one preferred embodiment of this invention shown in FIG. 11, package 101 is assembled for carrying a plurality of containers 5 in an upper level and a plurality of containers 5' in a lower level. Package 101 is assembled with a carrier 110 including retainer sheet portion 115 having a plurality of container receiving openings 120 for stretchingly engaging the plurality of containers 5 and a stretchable carrier sleeve portion 130 integrated with at least two side edges of retainer sheet portion 115. The stretchable material may be the same or different for each of carrier sleeve portion 130 and retainer sheet portion 115.

Container receiving openings 120 are preferably engaged with a plurality of containers 5 arranged in the upper level wherein each container receiving opening 120 is engaged with a container 5 in the upper level. A lower level of containers 5' is additionally positioned below the upper level and within stretchable carrier sleeve portion 130. Additionally, divider 160 is positioned between the upper level of containers 5 and the lower level of containers 5' within package 101.

During manufacture as described above, seam 140 may be formed to 5 join carrier sleeve portion 130 and retainer sheet portion 115. According to one preferred embodiment of this invention, seam 140 is positioned along an overlapping area between carrier sleeve portion 130 and retainer sheet portion 115. Seam 140 preferably extends longitudinally along each side of package 101. Seam 140 may be added in a manner similar to the method described above and shown in FIG. 10 by heat sealing, laminating or otherwise attaching carrier sleeve portion 130 and retainer sheet portion 115 to each other. Additionally, cutouts 170 may be formed in each transverse end of carrier 110 to facilitate sealing carrier sleeve portion 130 to retainer sheet portion 115, thereby preventing seam 140 from extending entirely around the perimeter of package 101.

Package 101 may be separated into a separately portable upper level of containers 5 and lower level of containers 5'. To facilitate such separation, package 101 may further comprise pull tab 145 positioned in carrier sleeve portion 130. Pull tab 145 preferably connects tear strip 149 extending around at least a portion of the perimeter of package 101. Tear strip 149 may be formed on each side of seam 140 extending between carrier sleeve portion 130 and retainer sheet portion 115. As such, tear strip 149 may be positioned in carrier sleeve portion 130 for disassociating containers 5 in the upper level from package 101 from containers 5' in the lower level of package 101. Because carrier sleeve portion 130 preferably surrounds each side and a bottom of the lower level of containers 5', the remaining package, essentially a group of loose containers in a bag-like carrier formed by at least a portion of carrier sleeve portion 130, may be separately portable following disassociation of the upper level of containers 5.

According to one preferred embodiment of this invention, divider 160 comprises a paperboard sheet having a footprint approximately corresponding with a footprint of package 101. As such, divider 160 preferably extends inside of carrier sleeve portion 130 and entirely between the upper level of containers 5 and the lower level of containers 5'. Accordingly, divider 160 prevents metal to metal contact between the upper level of containers 5 and the lower level of containers 5' thereby preventing can abrasion and unwanted nesting between containers in the upper and lower levels. In addition, divider 160 may include marketing and promotional information, including game pieces, coupons, instructions and similar space for product-related promotions and descriptions.

As in the embodiments described above, a handle may be integrated with retainer sheet portion 115 and extend over a top of package 101. The handle may be formed from a double layer of retainer sheet portion 115. As shown in FIG. 11, the handle may comprise finger loops 155 for grasping package 101.

While in the foregoing specification this invention has been described in relation to certain preferred embodiments thereof, and many details have been set forth for purpose of illustration, it will be apparent to those skilled in the art that the carrier and package are susceptible to additional embodiments and that certain of the details described herein can be varied considerably without departing from the basic principles of the invention.

I claim:

1. A package for carrying a plurality of containers, the package comprising:

a carrier including a retainer sheet portion having a plurality of container receiving openings for stretchingly engaging the plurality of containers and a stretchable carrier sleeve portion integrated with at least two side edges of the retainer sheet portion;

a plurality of containers arranged in an upper level and a lower level, each container receiving opening of the plurality of container receiving openings engaged with a container in the upper level of the plurality of containers;

a divider positioned between the upper level and the lower level of containers; and a handle integrated with the retainer sheet portion and extending over a top of the package.

2. The package of claim 1 further comprising:

a seam formed between the carrier sleeve portion and the retainer sheet portion.

3. The package of claim 2 wherein the seam is positioned along an overlapping area between the carrier sleeve portion and the retainer sheet portion.

4. The package of claim 1 further comprising a pull tab positioned in the carrier sleeve portion, the pull tab connecting a tear strip extending around at least a portion of the perimeter of the package.

5. The package of claim 4 wherein the tear strip is formed on each side of a seam extending between the carrier sleeve portion and the retainer sheet portion.

6. The package of claim 1 wherein the divider comprises a paperboard sheet having a footprint approximately corresponding with a footprint of the package.

7. A package of a plurality of containers, the package comprising:

a carrier including a retainer sheet portion and a carrier sleeve portion, the retainer sheet portion having a plurality of container receiving openings arranged in longitudinal rows;

a seam extending between the retainer sheet portion and the carrier sleeve portion;

a plurality of containers arranged in an upper level and a lower level, each container receiving opening of the plurality of container receiving openings engaged with a container in the upper level of the plurality of containers, the carrier sleeve portion positioned around the plurality of containers;

a divider positioned inside of the carrier sleeve portion and extending between the upper level of the plurality of containers and the lower level of the plurality of containers; and a handle positioned over a top of the package.

8. The package of claim 7 wherein the carrier sleeve portion surrounds each side and a bottom of the package of the plurality of containers.

9. The package of claim 7 wherein the handle is formed from a double layer of the retainer sheet portion.

10. The package of claim 7 further comprising a tear strip positioned in the carrier sleeve for disassociating one or more containers in the upper level of the plurality of containers from the package.

11. The package of claim 10 wherein the tear strip disassociates all containers in the upper level of the plurality of containers from the package.

12. A package of a plurality of containers, the package comprising:

a carrier including a retainer sheet portion and a carrier sleeve portion, each of the retainer sheet portion and the carrier sleeve portion formed of a stretchable material, the retainer sheet portion having a plurality of container receiving openings;

a seam extending within overlapping portions of the retainer sheet portion and the carrier sleeve portion along a longitudinal edge of the package;

a plurality of containers arranged in an upper level and a lower level, each container receiving opening of the plurality of container receiving openings engaged with a container in the upper level of the plurality of containers, the carrier sleeve portion positioned around both the upper level and the lower level of the plurality of containers;

a divider positioned inside of the carrier sleeve portion and extending between the upper level of the plurality of containers and the lower level of the plurality of containers.

13. The package of claim 12 further comprising:

a handle positioned over a top of the package.

14. The package of claim 13 wherein the handle comprises two thicknesses of the retainer sheet portion fastened together with a seal.

15. The package of claim 12 further comprising:

a tear strip positioned along the longitudinal edge of the package, the tear strip tearable to disassociate all containers in the upper level of the plurality of containers from the package.

16. The package of claim 12 wherein the divider comprises a paperboard sheet.

17. The package of claim 12 wherein the stretchable material is different for each of the carrier sleeve portion and the retainer sheet portion.

18. The package of claim 12 wherein the retainer sheet portion comprises a thicker stretchable material than the carrier sleeve portion.

19. The package of claim 12 wherein the carrier sleeve portion surrounds the plurality of containers on five sides.

20. A package for carrying a plurality of containers, the package comprising:

a carrier including a retainer sheet portion having a plurality of container receiving openings for stretchingly engaging the plurality of containers and a stretchable carrier sleeve portion integrated with at least two side edges of the retainer sheet portion;

a plurality of containers arranged in an upper level and a lower level, each container receiving opening of the plurality of container receiving openings engaged with a container in the upper level of the plurality of containers;

a divider positioned between the upper level and the lower level of containers; and a pull tab positioned in the carrier sleeve portion, the pull tab connecting a tear strip extending around at least a portion of the perimeter of the package.

* * * * *